US008641811B2

(12) United States Patent
Mathena

(10) Patent No.: US 8,641,811 B2
(45) Date of Patent: Feb. 4, 2014

(54) ECOLOGICALLY SENSITIVE MUD-GAS CONTAINMENT SYSTEM

(75) Inventor: Harold Dean Mathena, Edmond, OK (US)

(73) Assignee: Mathena, Inc., El Reno, OK (US)

( * ) Notice: Subject to any disclaimer, the term of this patent is extended or adjusted under 35 U.S.C. 154(b) by 309 days.

(21) Appl. No.: 13/000,964

(22) PCT Filed: Jun. 30, 2008

(86) PCT No.: PCT/US2008/008143

§ 371 (c)(1),
(2), (4) Date: Dec. 22, 2010

(87) PCT Pub. No.: WO2010/002360

PCT Pub. Date: Jan. 7, 2010

(65) Prior Publication Data

US 2011/0114389 A1 May 19, 2011

(51) Int. Cl.
*B01D 19/00* (2006.01)

(52) U.S. Cl.
USPC ..... 96/155; 96/157; 96/187; 175/66; 175/206; 166/75.11; 166/81.1

(58) Field of Classification Search
USPC ..... 96/155–220; 175/57–72, 206; 166/81.1, 166/57–72, 206, 75.11–97.5
See application file for complete search history.

(56) References Cited

U.S. PATENT DOCUMENTS 2,166,516 A 7/1939 Bainbridge
3,765,505 A 10/1973 Pendleton
3,875,998 A 4/1975 Charpentier
3,965,967 A 6/1976 Jentzsch et al.
4,154,570 A * 5/1979 Schwartz ..... 431/186
4,294,593 A 10/1981 Rehm
4,297,659 A * 10/1981 Augst ..... 333/191

(Continued)

FOREIGN PATENT DOCUMENTS

CA 2729154 1/2010
CH 697992 B1 4/2009

(Continued)

OTHER PUBLICATIONS

Co-pending U.S. Appl. No. 29/448,068, filed Mar. 8, 2013.

(Continued)

*Primary Examiner* — Duane Smith
*Assistant Examiner* — Thomas Mckenzie
(74) *Attorney, Agent, or Firm* — Haynes and Boone, LLP

(57) ABSTRACT

This invention relates to an ecologically and environmentally friendly mud-gas containment system. Specifically, this invention relates to a mobile device that is capable of receiving waste gas and, in emergency situations, a volume of a mud-gas mixture from a drilling operation. The waste gas is communicated to a removable flare stack through a vent line. The mud-gas is received at a containment vessel. The impact of the mud-gas within the containment vessel separates the mud-gas into mud and waste gas. The mud is collected for recycling and/or environmentally sensitive disposal. The waste gas from the vessel is communicated to the flare stack. Separate removal ports and conduits are used to remove any residual mud or mud-gas from the vent line and/or containment vessel. Excess mud or mud-gas is communicated to an overflow catch tank for removal. The entire assembly is mounted on a mobile skid sized for highway transportation.

9 Claims, 15 Drawing Sheets

(56) References Cited

U.S. PATENT DOCUMENTS

| | | | | | |
|---|---|---|---|---|---|
| 4,373,354 | A | | 2/1983 | Sawyer | |
| 4,397,659 | A | | 8/1983 | Gowan et al. | |
| 4,474,254 | A | | 10/1984 | Etter et al. | |
| 4,666,471 | A | * | 5/1987 | Cates | 95/262 |
| 5,267,367 | A | | 12/1993 | Wegmann, Jr. | |
| 5,599,365 | A | | 2/1997 | Alday et al. | |
| 5,755,527 | A | | 5/1998 | Dufresne | |
| 5,777,266 | A | | 7/1998 | Herman et al. | |
| 5,919,036 | A | | 7/1999 | O'Brien et al. | |
| 5,928,519 | A | * | 7/1999 | Homan | 210/741 |
| D412,490 | S | | 8/1999 | Henry | |
| D415,112 | S | | 10/1999 | Henry | |
| D415,471 | S | | 10/1999 | Henry | |
| 5,997,284 | A | * | 12/1999 | Gustafson et al. | 431/202 |
| 6,067,681 | A | | 5/2000 | Zeinstra et al. | |
| D429,695 | S | | 8/2000 | Henry | |
| 6,202,565 | B1 | | 3/2001 | Henry | |
| 6,287,047 | B1 | | 9/2001 | Dufresne | |
| 6,481,036 | B1 | | 11/2002 | Duvall | |
| 6,499,410 | B1 | | 12/2002 | Berardi | |
| 6,747,212 | B1 | | 6/2004 | Henry | |
| 6,878,881 | B1 | | 4/2005 | Henry | |
| 7,145,079 | B1 | | 12/2006 | Henry | |
| 7,309,836 | B2 | | 12/2007 | Lubanski | |
| D563,323 | S | | 3/2008 | Henry | |
| 7,377,336 | B2 | | 5/2008 | Duhe et al. | |
| 7,385,139 | B2 | | 6/2008 | Lubanski | |
| 7,592,547 | B2 | | 9/2009 | Lubanski | |
| 7,595,450 | B2 | | 9/2009 | Lubanski | |
| 7,674,980 | B2 | | 3/2010 | Lubanski | |
| 7,795,535 | B2 | | 9/2010 | Lubanski | |
| 7,838,772 | B2 | | 11/2010 | Lubanski | |
| 8,001,643 | B1 | | 8/2011 | James | |
| 2005/0166759 | A1 | * | 8/2005 | Ross et al. | 96/155 |
| 2007/0151907 | A1 | * | 7/2007 | Duhe et al. | 210/170.01 |
| 2007/0175331 | A1 | * | 8/2007 | Tomshak et al. | 96/204 |
| 2009/0255560 | A1 | | 10/2009 | Lehmann et al. | |
| 2013/0047351 | A1 | | 2/2013 | Breault | |

FOREIGN PATENT DOCUMENTS

| | | | |
|---|---|---|---|
| CN | 2886155 | Y | 4/2007 |
| EP | 0050312 | A2 | 4/1982 |
| FR | 2641362 | A1 | 7/1990 |
| GB | 163186 | A | 5/1921 |
| GB | 2240801 | A | 8/1991 |
| JP | 2001070469 | A | 3/2001 |
| WO | 2008068828 | A1 | 6/2008 |
| WO | 2009097869 | A1 | 8/2009 |
| WO | 2010002360 | A1 | 1/2010 |
| WO | 2012141691 | A1 | 10/2012 |

OTHER PUBLICATIONS

Co-pending U.S. Appl. No. 29/453,843, filed May 5, 2013.
Co-pending U.S. Appl. No. 29/453,882, filed May 5, 2013.
International Preliminary Report on Patentability by the IPEA/US, mailed May 13, 2011, regarding PCT/US2008/008143.
International Search Report and Written Opinion, by the ISA/US, mailed Jul. 5, 2011, regarding PCT/US2011/032122.
International Search Report and Written Opinion by the ISA/US, mailed Oct. 9, 2008, regarding PCT/US2008/008143.
WP Resources LLC. Web. Jul. 30, 2013; <http://www.w-p-resources.com/>, 15 pages.
Mathena, "Vent Line Drive-Over" (brochure), 2 pages; 2012.
Official Action for MX/a/2011/000055 by Mexican Patent Office (English translation), 2013.

* cited by examiner

ECOLOGICALLY SENSITIVE MUD-GAS CONTAINMENT SYSTEM

BACKGROUND OF THE INVENTION

This invention relates to a mobile, ecologically and environmentally friendly mud-gas containment system mounted upon a single, highway transportable skid. The mobile device receives, from drilling, production, and/or completion operations, both a waste gas and a volume of drilling mud having entrained and commingled waste gas. The waste gas is communicated to a removable flare stack. The volume of the drilling mud, with entrained waste gas, is received at a containment vessel. This invention also relates to capturing and storing the drilling mud for recycling.

During well drilling, production, and/or completion operations, numerous operational activities and components function simultaneously. Drilling fluid, also called "mud," is used for the lubrication, cooling, and removal of the cuttings from the well during the drilling, production, and/or completion operations. Because the mud is used within the well, waste gas from the well becomes entrained and commingled within the mud, creating a mud-gas mixture. During drilling operations, safely separating the gas from the mud-gas mixture usually requires communicating the mud-gas mixture to a mud-gas separator. Subsequently, substantially gas-free mud passes to a holding tank or reserve pit for recycling at a later date. Simultaneously, the released waste gas is burned at a flare stack.

In the event of a well blow out or other emergency, the mud-gas mixture from a wellbore is rapidly dumped into the holding tank or reserve pit. Unfortunately, the gradual outgassing of waste gas from the mud mixture creates a combustion hazard near the well site. Capture and safe disposal of the waste gas is limited or non-existent for such situations.

When employing a standard mud-gas separator, a vent line communicates the waste gas away from the well site, or a mud-gas separator, to the flare stack. Unfortunately, currently available mud-gas separators frequently pass some mud with the gas through the vent line with the waste gas. Over time, the mud residue within the vent line begins to impede and eventually block the flow of waste gas to the flare stack. The usual method to remove the mud residue is to disassemble the vent line and flush the residue out.

Environmental concerns and technology improvements have dictated that waste products be captured at the well site while presenting a smaller footprint for well drilling operations. Thus, it is important to design the components for well operations to be carried on transportation skids. Well operations typically include well drilling, production, and/or completion operations. The mobility helps prevent any by-products of the process from contaminating the area. Numerous transportation skids are required to carry all of the well site support equipment used to capture waste products. To reduce the number of skids at a well site, a single skid carrying all the components of an ecological friendly mud-gas containment system is desired. The skid-based ecological mud-gas containment system should provide for: safe flaring of waste gas; environmentally safe removal of the mud residue build-up in a flare stack vent line; emergency dumping of the mud-gas mixture from a well with continued waste gas separation from the mud-gas mixture; and recovery of the mud for recycling. The present invention solves the foregoing problems by providing an environmentally/ecologically friendly mobile mud-gas containment system.

SUMMARY OF THE INVENTION

The present invention provides an ecologically improved system to capture a mud-gas mixture and to safely dispose of waste gas from a wellbore. In one aspect, the present invention is a single skid having a small footprint, carrying all of the components of a mud-gas containment system. Another aspect of the current invention significantly reduces the opportunity for an inadvertent spill of mud. Particularly, the present invention provides a containment and disposal system for any excess mud-gas mixture resulting from a blow out or other emergency. Any released waste gas is burned in a fluidly connected flare stack carried by the mud-gas containment system. The present invention also allows for removal of any buildup of residual mud in the vent line feeding the flare stack. The mud is transferred from the vent line to the overflow catch tank. For the entire system, captured mud-gas mixture is eventually removed for environmentally friendly recovery, recycling, or disposal.

In one embodiment, the present invention provides for an environmentally friendly mud-gas containment system. The system comprises a gas vent line which is in fluid communication with both the wellbore and a flare stack. The gas vent line transports waste gas to the flare stack. The system also comprises at least one input line in fluid communication with a wellbore and a vessel. An overflow line carries any excess mud-gas mixture from the vessel to a catch tank. Additionally, the gas vent line carries a residual drain line for removal of residual mud from the gas vent line.

The current invention also provides a waste gas disposal system. The waste gas disposal system comprises a gas vent line in fluid communication with a wellbore and a flare stack. The waste gas disposal system also comprises a trap, a drain line and a drain port. The drain line provides a conduit from the trap for removing the build-up of any residual mud in the gas vent line.

In yet another embodiment, the current invention provides a mud recovery system. The mud recovery system comprises a gas vent line in fluid communication with a wellbore and a flare stack. The gas vent line includes an elbow, or trap, which captures or retains any residual mud carried by the waste gas. An access port provides external access to the trap. A drain line connected to the gas vent line provides for removal of the residual quantity of the mud.

Still further, the current invention provides a mobile mud-gas containment apparatus. The mobile mud-gas containment apparatus has a gas vent line for receiving a fluid communication from the wellbore. The gas vent line is also in fluid communication with a flare stack. The mobile mud-gas containment apparatus also has at least one input line for receiving a fluid communication from a wellbore and in fluid communication with a vessel. The input line transports the mud-gas mixture from the wellbore to the vessel. An overflow line in fluid communication with the vessel and a catch tank permits removal of excess mud-gas mixture from the vessel. The gas vent line, vessel and catch tank are mounted upon a mobile skid, with each component being detachable from their respective wellbore connections.

Numerous objects and advantages of the invention will become apparent as the following detailed description of the preferred embodiments is read in conjunction with the drawings, which illustrate such embodiments.

BRIEF DESCRIPTION OF THE DRAWINGS

FIG. 6 depicts a perspective front view of the vessel.

FIGS. 9A and 9B depict a perspective view of the catch tank interior back.

DETAILED DESCRIPTION

Apparatus—Mud-Gas Containment System

Figure 1:
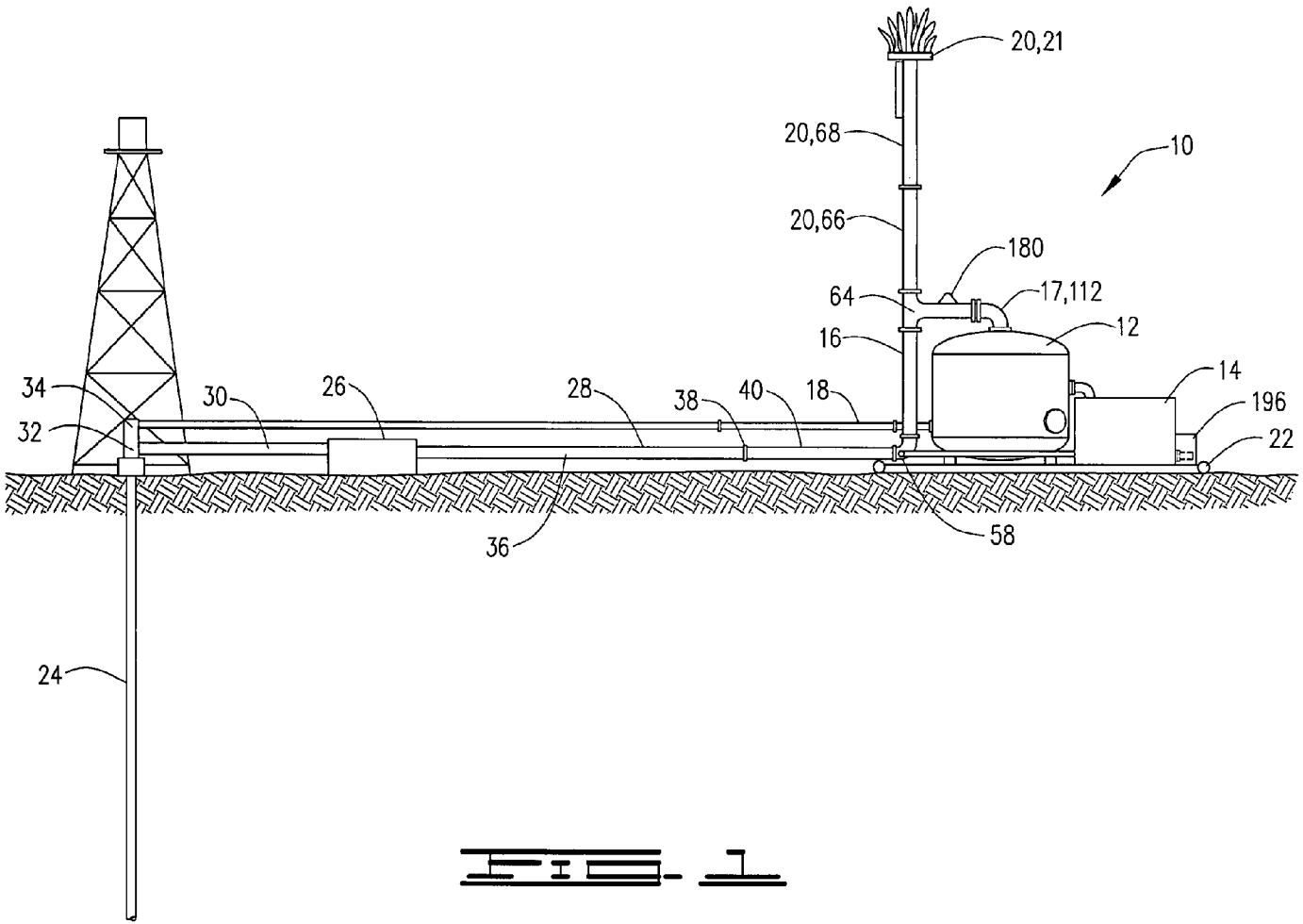
FIG. 1 depicts drilling, production, and/or completion operations in fluid communication with an ecological friendly mud-gas containment system.

Referring to FIGS. 1-3, 5A-B, and 12A-B, the entire mud-gas containment system 10 of the present invention is depicted mounted upon skid 22. Skid 22 is designed to be trailered to or from a well site using the United States' state and federal highways without requiring special use permits for width, height or weight.

The primary, interrelated systems of this invention are vessel 12, catch tank 14, vent line 16, and flare stack 20. Vessel 12 is the first interrelated system, with catch tank 14, vent line 16, and flare stack 20 being the second, third and fourth interrelated systems respectively. The interrelated systems are connected to wellbore 24. Wellbore 24 is connected to vessel 12 and vent line 16 as described herein. As depicted in FIGS. 1-3, 5A-B, and 12A-B, vessel 12, catch tank 14, vent line 16, flare stack 20 and the associated power/control systems are integrally mounted upon and to skid 22.

Vessel 12 is in fluid communication with both flare stack 20 through T-joint 64 and catch tank 14 through overflow line 128. Additionally, to drain any remaining mud-gas mixture from vessel 12, vessel drain line 120 via drain line input port 121 provides an alternate fluid path to catch tank 14. T-joint 64 provides a fluid communication from vent line 16 to flare stack 20. For transportation purposes, flare stack 20 detachably connects at T-joint 64. As used herein, flare stack 20 carries flare stack feed lines 66, 68, igniter 82, and burner 21.

In addition to receiving fluid from vessel 12, catch tank 14 is in fluid communication with vent line 16 at elbow 58. Elbow 58 may be an integral component of vent line 16 or may be a separate unit affixed to vent line 16. Elbow 58 preferably provides the fluid communication transition between gas tube 28 and vent line 16 at waste gas entry point 60, hence the shape of elbow 58 may be any shape that provides transition between gas tube 28 and vent line 16. Furthermore, elbow 58 preferably provides a detachable connection to gas tube 28. Additionally, elbow 58 preferably carries trap 151. Accumulated residual mud passes from trap 151 in elbow 58 to catch tank 14 through residual mud drain line 150 and drain line 158.

Figure 7A:
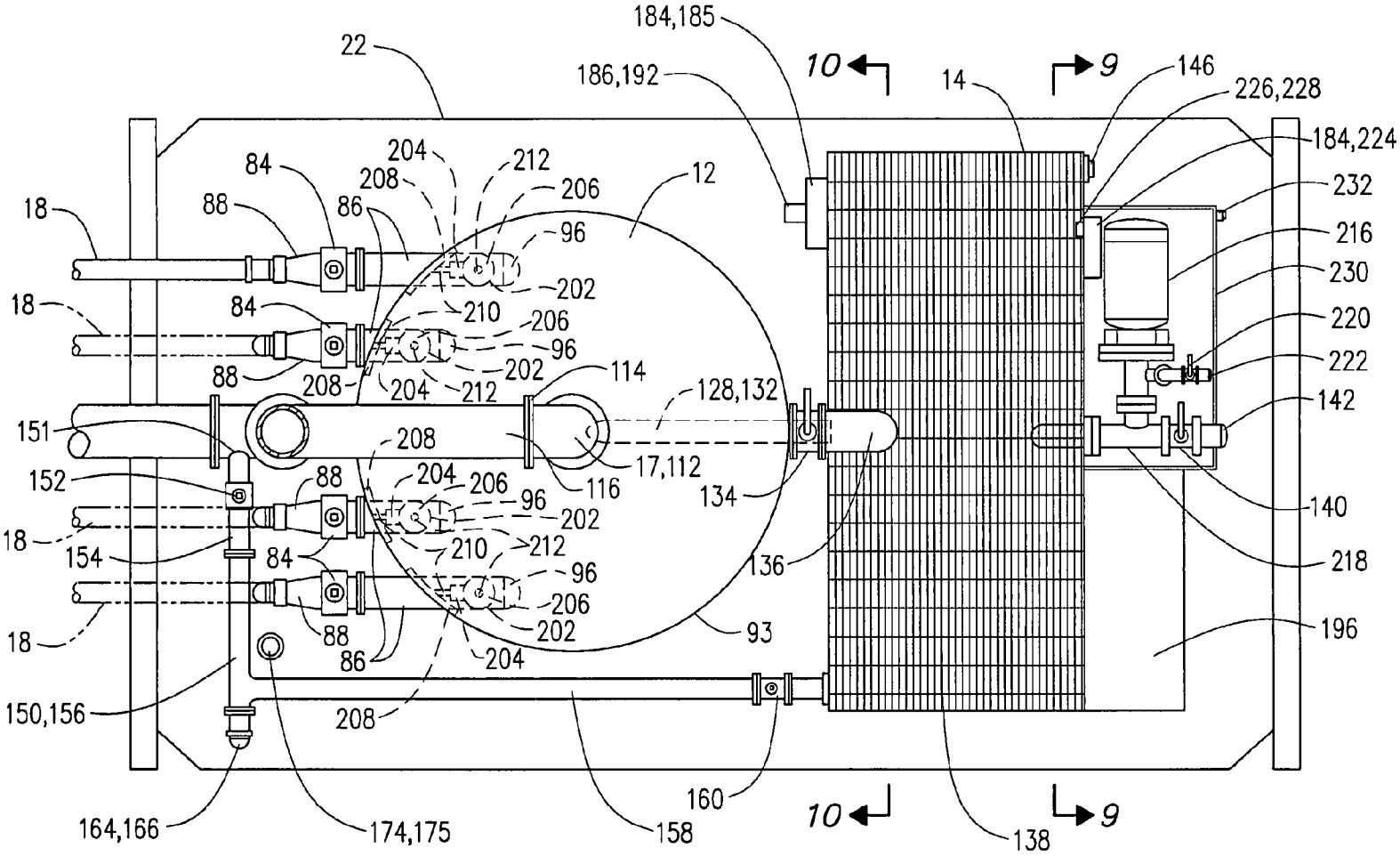
FIGS. 7A and 7B depict a top plan view of the vent line, vessel, and overflow catch tank mounted upon the skid.
Figure 7:
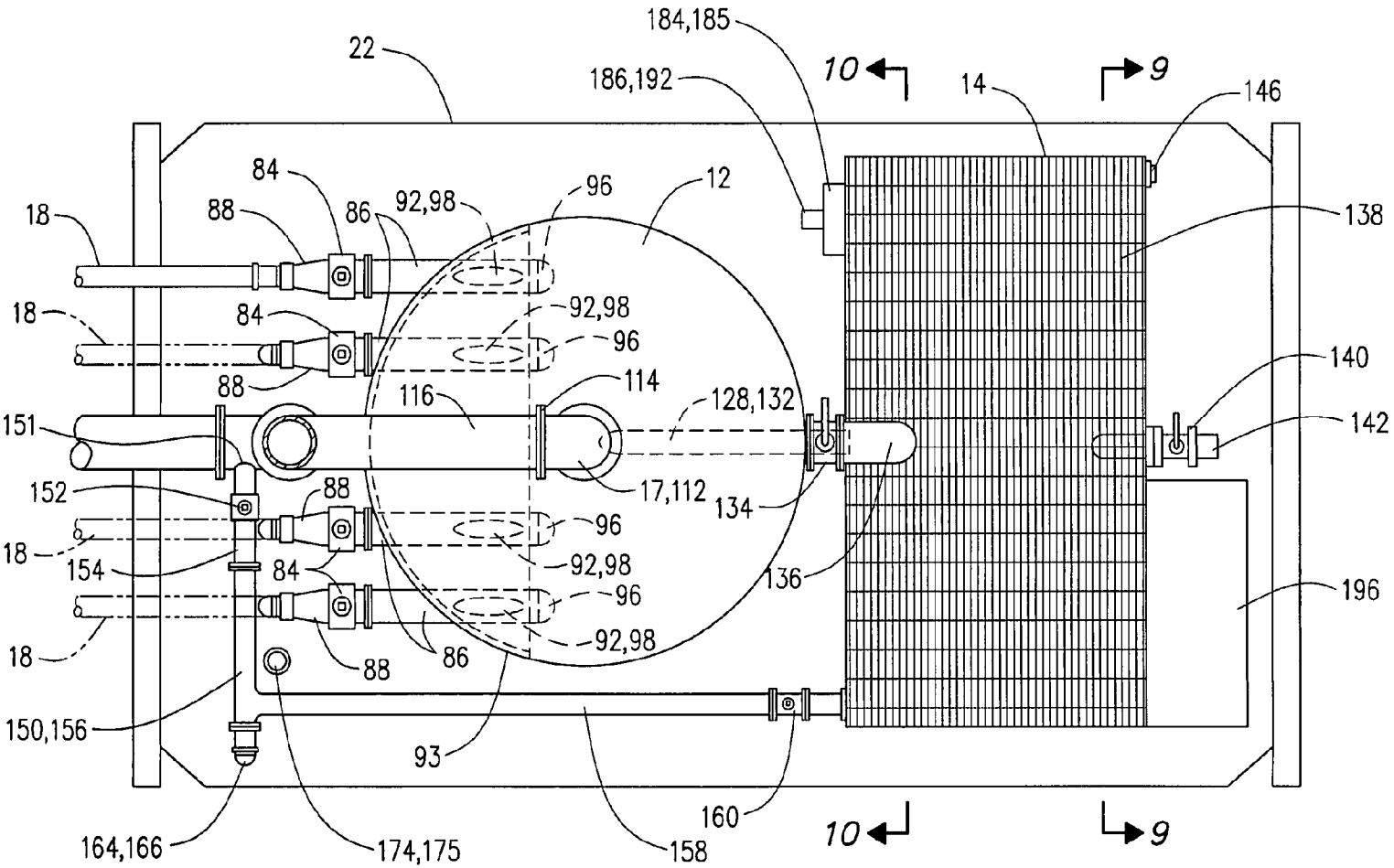
Figure 12:
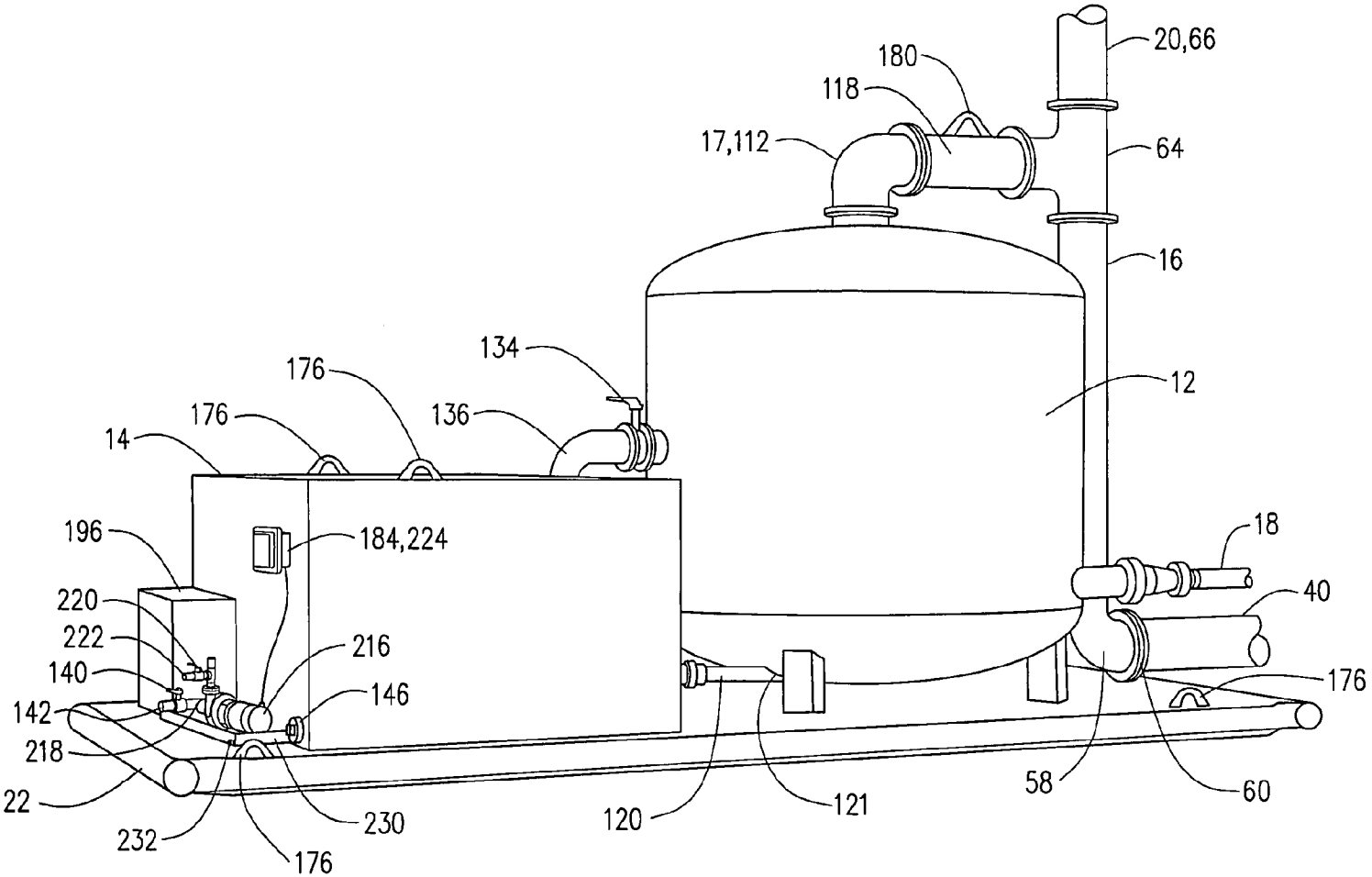
FIGS. 12A and 12B depict a left rear perspective view of the catch tank and vessel.
Figure 13:
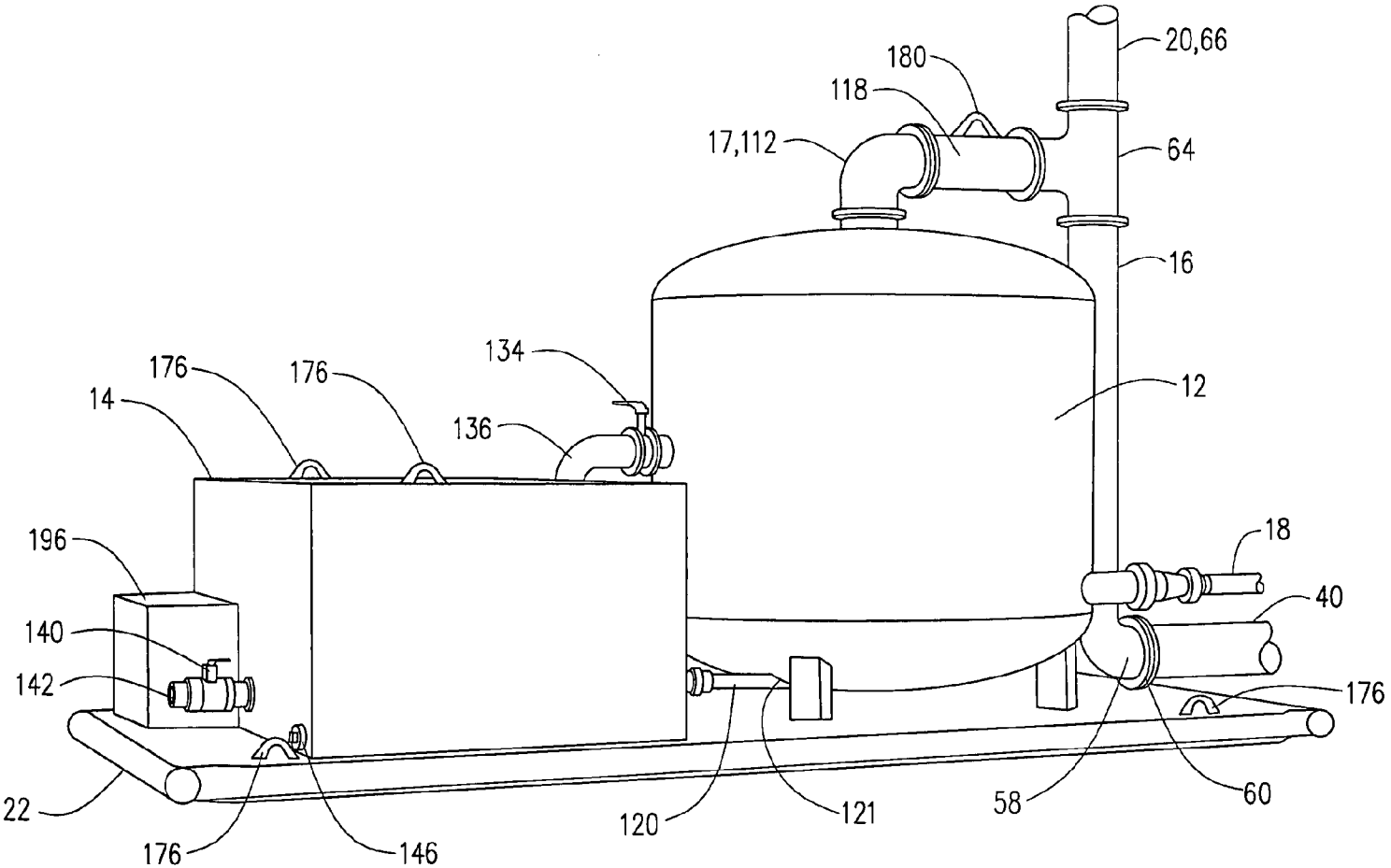
FIG. 13 depicts a perspective view of overflow line intake and vessel drain line.
Figure 13:
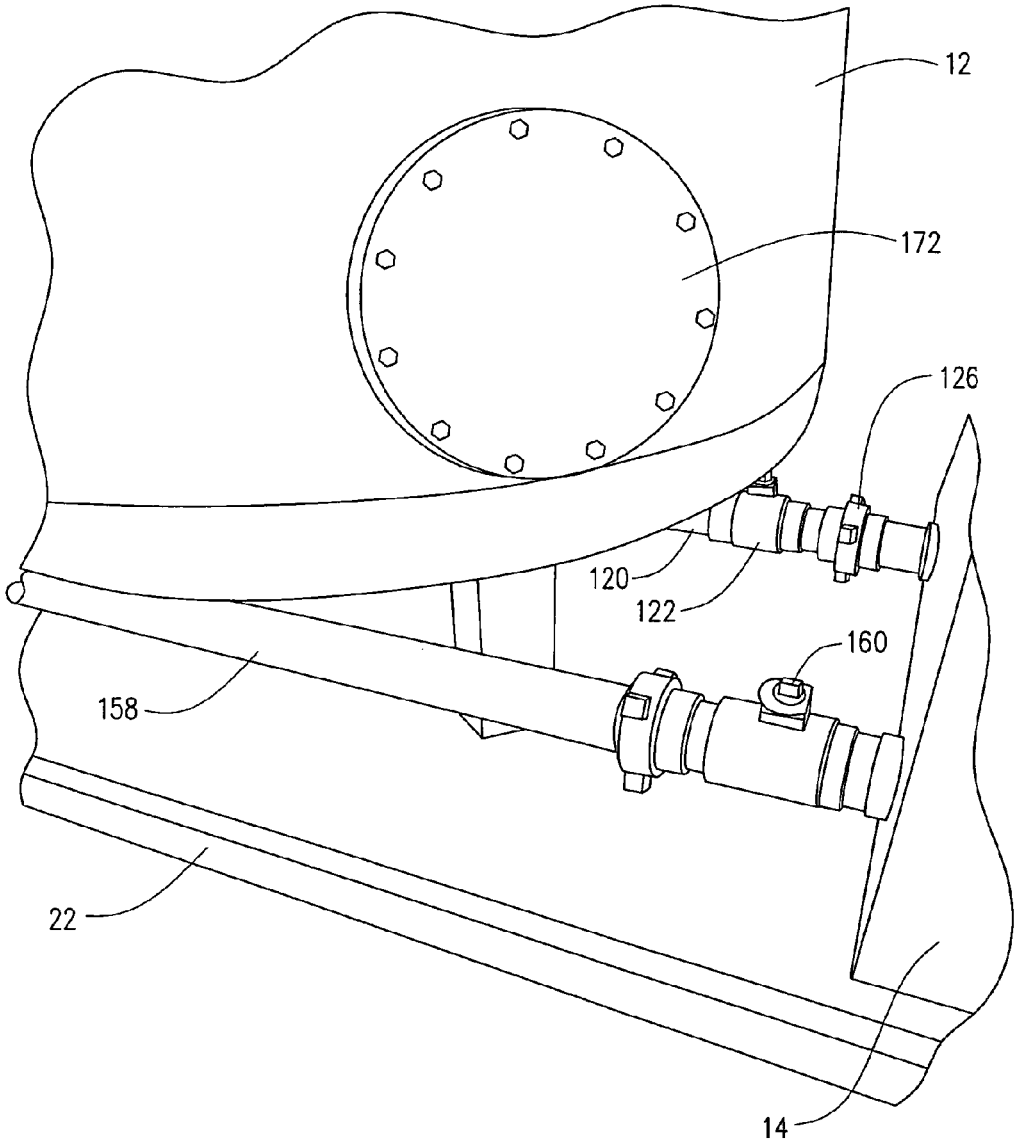

Mud-gas containment system 10 further includes a control system 184 for management operations. Preferably, control system 184 mounts to skid 22, vessel 12 or catch tank 14. As those skilled in the art know, control system 184 may be separated into numerous components to facilitate and provide the necessary control mechanism for managing the operations of mud-gas containment system 10. As depicted in FIGS. 7A-B and 12A, control system 184 is preferably separated into two components. The first component, control panel 185, preferably controls igniter 82 and provides safety switches. The second component, power/control panel 224, preferably controls the volume of the mud-gas mixture in overflow tank 14. Control system 184 receives power from a separate power source such as a generator (not shown).

Vessel 12 is in fluid communication with wellbore 24 through panic line 18. Preferably, panic line 18 is detachable from conical adapter 88, which is carried by vessel 12. Panic line 18 enables removal of the mud-gas mixture from wellbore 24 in the event of a blow-out or other emergency. In a preferred embodiment, vessel 12 receives at least one panic line 18 positioned between wellbore 24 and vessel 12. Other embodiments employ valves, manifolds and chokes to regulate part of the flow from wellbore 24 to vessel 12. When employed, these systems prevent excessive flow of the mud-gas mixture into vessel 12 in the event of a well blow out when a large volume of the mud-gas mixture is rapidly evacuated from wellbore 24.

Although panic line 18 is depicted as a single mud-gas supply line connected directly to wellbore 24, one skilled in the art will recognize that other systems or a plurality of segments may be inserted between panic line 18 and wellbore 24. As depicted in FIGS. 7A-B, mud-gas containment system 10 is designed to accommodate one or more panic lines 18 originating from one or more wellbores 24. The configuration of panic line 18 will vary depending upon the characteristics of each wellbore 24.

In addition to carrying conical adapter 88, vessel 12 also carries vessel input line 86. Preferably, vessel 12 has about four (4) vessel input lines 86 which communicate fluid from conical adapter 88 to an interior of vessel 12. It is preferred that vessel input line 86 be sized to receive fluid from at least a six (6) inch panic line 18. As shown in FIGS. 2, 3, and 5A-B, conical adapter 88 accepts an input ranging from four (4) inches to six (6) inches, thereby permitting use of a corresponding four (4) or six (6) inch panic line. Preferably, the system provides for the use of a plurality of conical adapters 88 of various sizes, thereby allowing connections to panic lines ranging from about one-half (0.5) inch to about six (6) inches. Although vessel input line 86 is shown as a single line, multiple pieces may be assembled to provide the same function of fluid communication.

Figure 5:
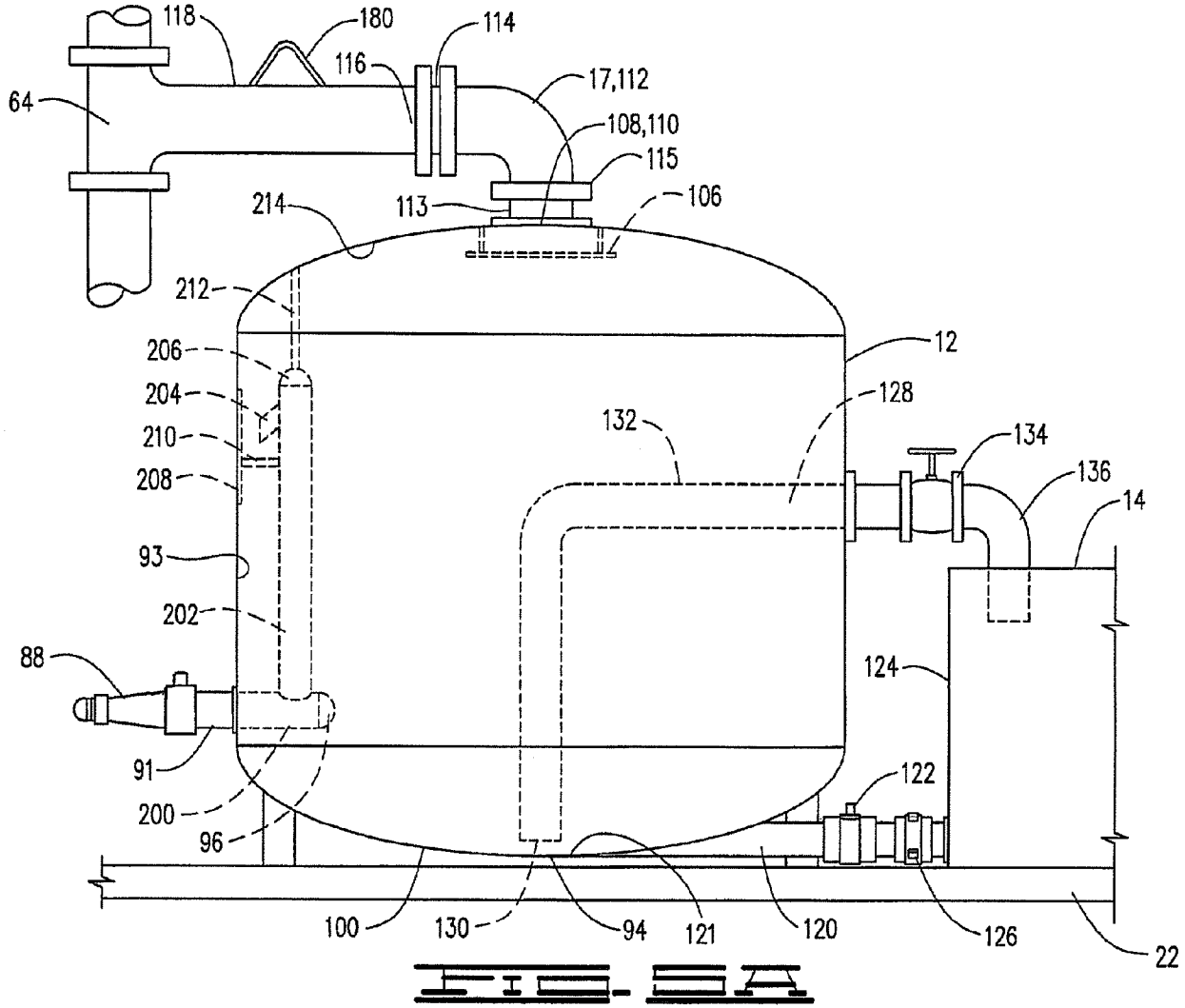
FIGS. 5A and 5B depict a right side view of the vessel.
Figure 5:
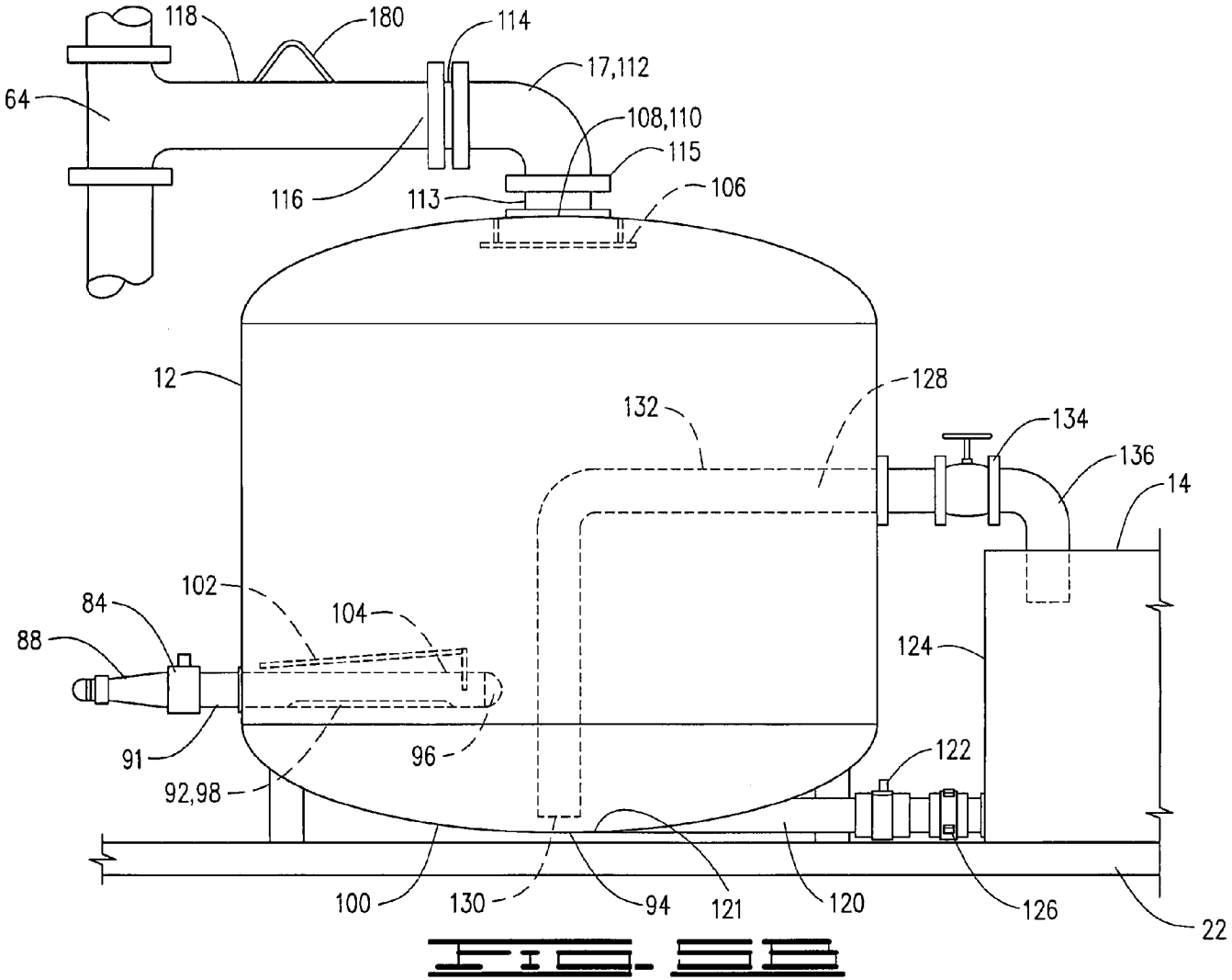
Figure 5:
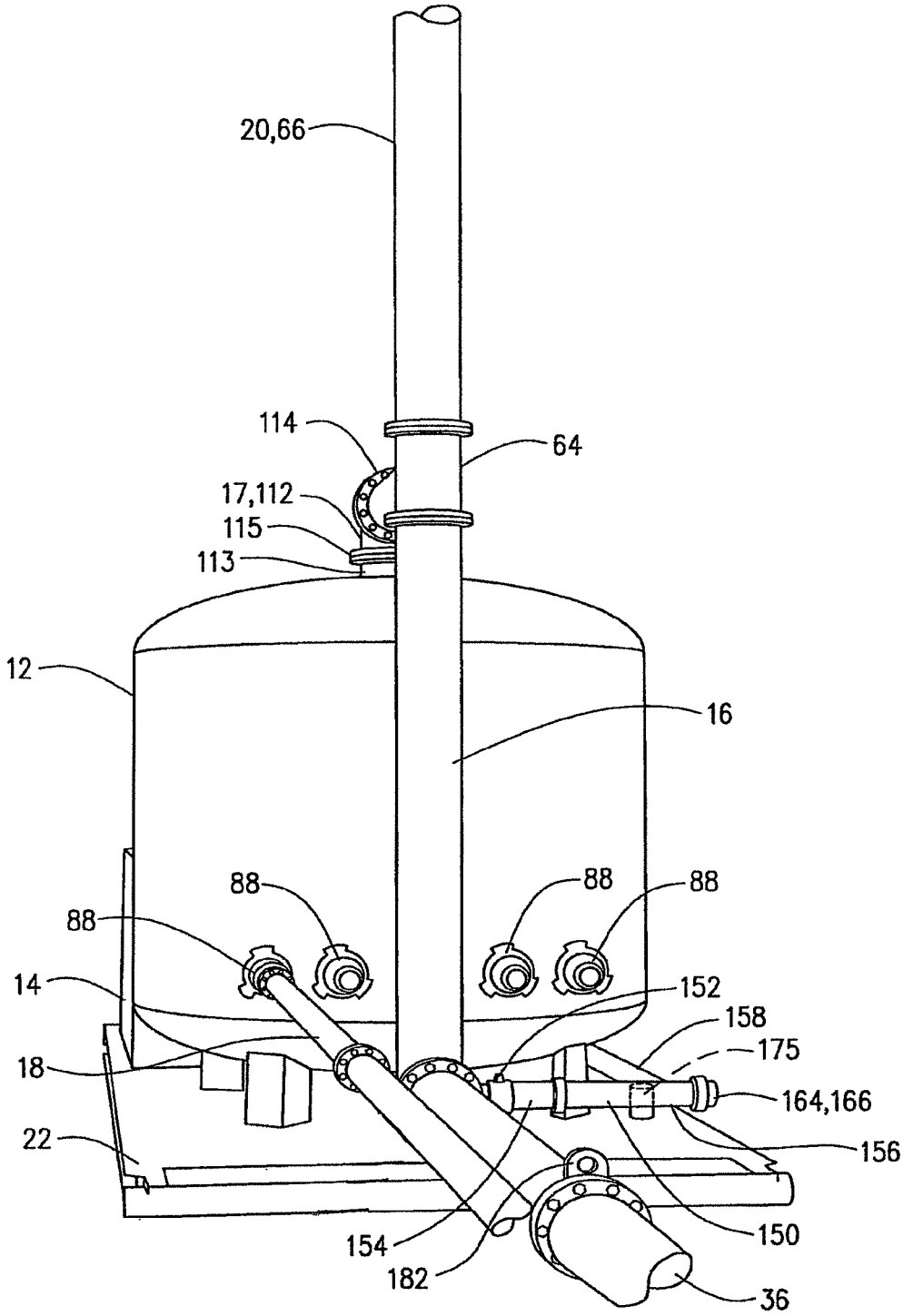
Figure 8A:
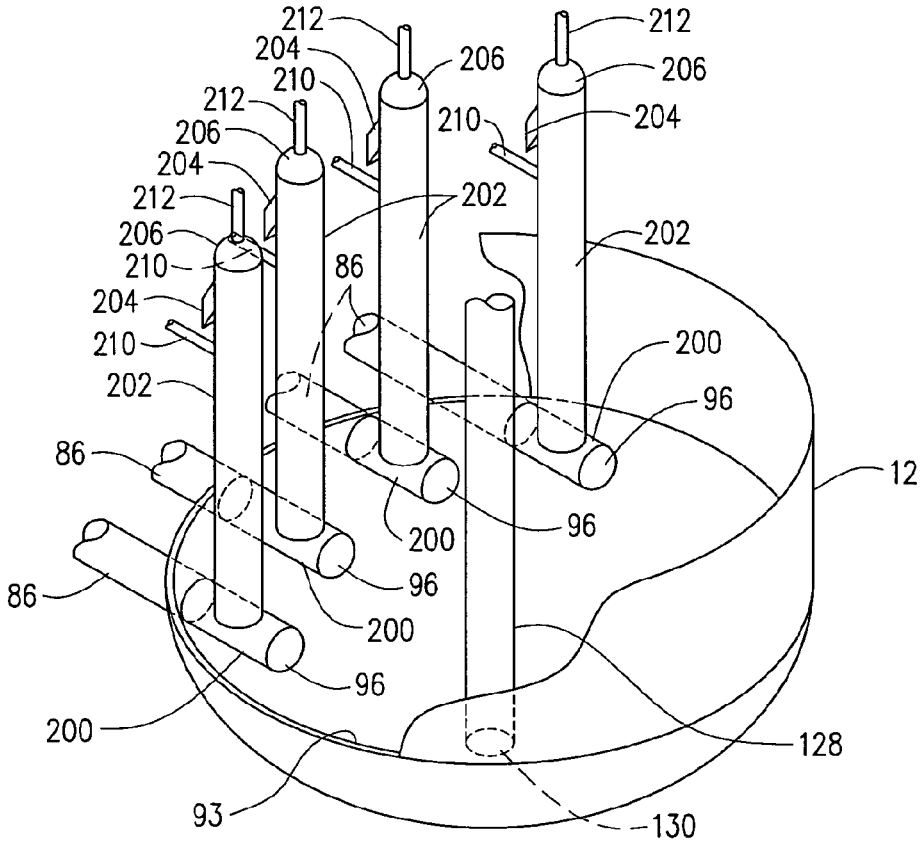
FIGS. 8A and 8B depict a perspective view of the vessel interior.

A particularly preferred embodiment of vessel 12 is depicted in FIGS. 5A, 7A, 8A, 9A, and 12A. Referring to FIGS. 5A, 7A, and 8A, vessel input line 86 carries riser T-segment 200 positioned inside vessel 12. Although smaller diameter risers will function, it is preferred that riser T-segment 200 be a six (6) inch diameter line that carries end cap 96. Each riser T-segment 200 is in fluid communication with riser pipe 202. Riser pipe 202 has outlet port 204 and end cap 206. Outlet port 204 is preferably angled in a sideways direction towards vessel wall 93 to discharge the mud-gas mixture into vessel 12. Outlet port 204 provides an angle of discharge between about one (1) and about ninety (90) degrees relative to riser pipe 202. Generally, the angle of discharge is between about thirty (30) and about sixty (60) degrees, with a preferred configuration providing an angle of discharge of about forty-five (45) degrees. The discharge from outlet port 204 impacts on wear plate 208. Wear plate 208 is a replaceable material designed to absorb the abrasive wear thereby protecting vessel wall 93 from erosion. The size of the outlet port 204 may be varied for different sized vessels 12. The particular size of outlet port 204 is based upon the need to minimize back pressure in panic lines 18, and the volume capacity of vessel 12.

Each riser pipe 202 is normally supported by at least one bracket. In the preferred embodiment, wall bracket 210 connects riser pipe 202 to vessel wall 93, and top bracket 212 connects end cap 206 to vessel top wall 214. As shown in FIGS. 5A, 7A and 8A, a single wall bracket 210 is centered on riser pipe 202 and near the middle of wear plate 208. However, wall bracket 210 may be positioned any place that provides stability for riser pipe 202. Additionally, a plurality of wall brackets 210 may be used and positioned to properly support riser pipe 202. Top bracket 212 is preferably centered on end cap 206, and affixed to vessel top wall 214 immediately above riser pipe 202. Alternatively, a plurality of top brackets 212 may be used and affixed at any location within vessel 12 that provide support for the riser pipe 202.

Figure 8B:
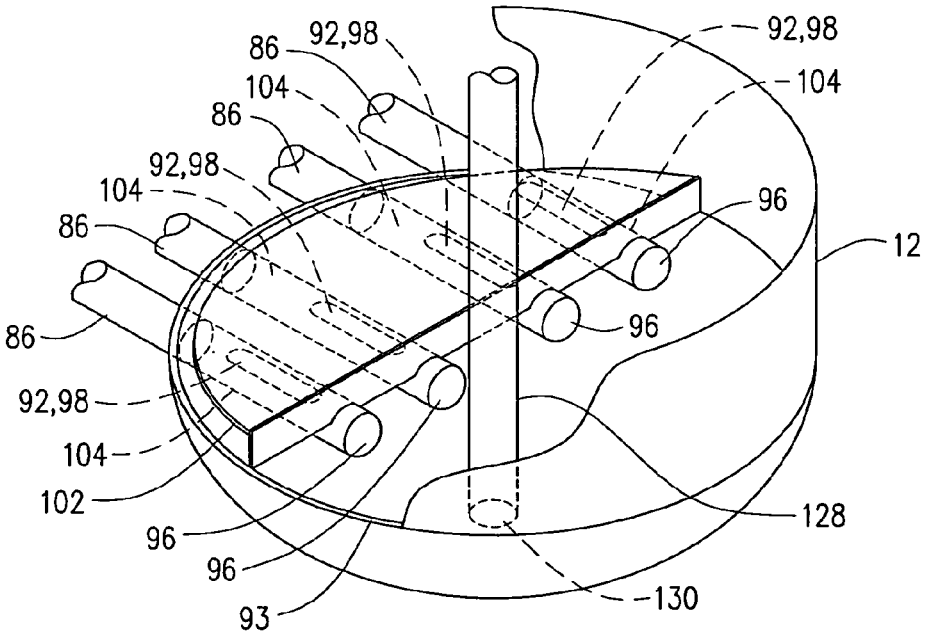
Figure 3A:
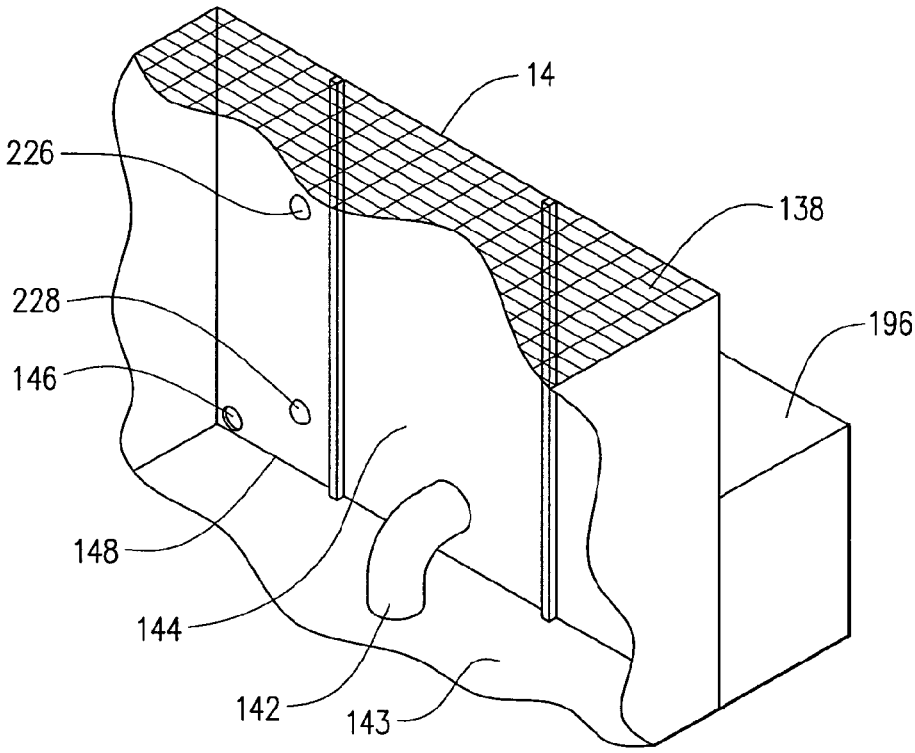
Figure 3B:
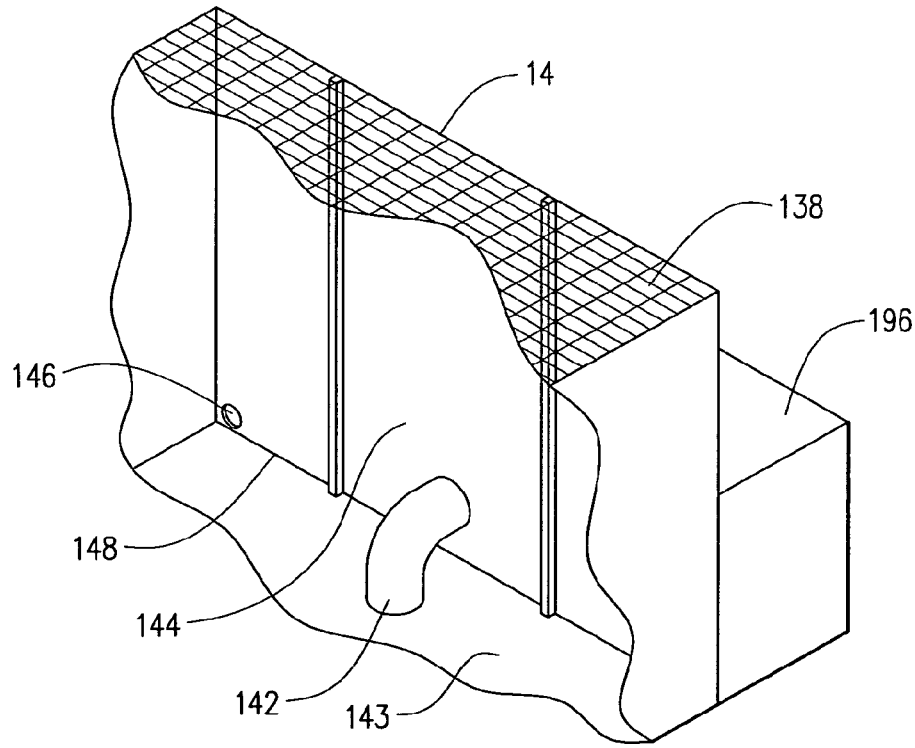

An alternate embodiment is depicted in FIGS. 5B, 7B, and 8B. As depicted therein, vessel input line 86 carries dump segment 92, which terminates inside vessel 12 near center 94 of vessel 12. Preferably, dump segment 92 is at least a six (6) inch diameter line carrying end cap 96. Each dump segment 92 has a dump opening 98 positioned within vessel 12. In a preferred embodiment, dump opening 98 is oriented towards bottom segment 100 of vessel 12, and provides a downward flow direction for the mud-gas mixture. Bottom segment 100 may also be referred to as bottom 100. Preferably, dump segment 92 and dump opening 98 are sized to facilitate the rapid disgorgement of mud-gas into vessel 12, thereby minimizing back pressure in panic line 18. In the preferred embodiment, dump opening 98 has an oblong configuration measuring about four (4) inches wide by about sixteen (16) inches long. In addition to minimizing panic line 18 back pressure, dump opening 18 may vary in configuration depending upon the volume of vessel 12. Preferably, vessel 12 has a volume capacity of about 55 barrels.

To prevent excessive splashing, wear plate 208, baffle plate 102 and top splash plate 106 are employed internal to vessel 12. Wear plate 208 was described above. Referring to FIGS. 5A-B and 8A-B, baffle plate 102 is shown covering dump segment top 104. Baffle plate 102 prevents the mud-gas mixture from splashing upwards in vessel 12. Further, as shown in FIGS. 5A-B, a top splash plate 106 is designed to block the mud-gas mixture from splashing into exit port 108.

As shown in FIGS. 5A-B, 7A-B, 8A-B, and 10, overflow line 128 is designed to prevent the build up of an excessive volume of the mud-gas mixture in vessel 12. Preferably, overflow line 128 has intake 130 positioned in the center 94, and close to the bottom segment 100 of vessel 12. Although intake 130 is depicted in FIGS. 5A-B and 8A-B without a screen or filter covering it, a screen or filter may optionally be affixed to intake 130 to prevent passage of debris into catch tank 14. As vessel 12 fills up, intake 130 is designed to receive the mud-gas mixture. Once a sufficient volume is achieved within vessel 12, horizontal segment 132 receives the mud-gas mixture from intake 130 and communicates the mud-gas mixture through valve 134 and subsequently out of overflow outlet 136. Preferably, valve 134 is a check valve, or any other type of valve that provides a one-way flow, and is either manually or remotely operated. Overflow outlet 136 is positioned to release the excess mud-gas mixture into catch tank 14. Overflow line 128 may be a single conduit, or a plurality of conduits.

Waste gas recovered in vessel 12 passes through exit port 108 and continues on through flare stack feed line 17 to flare stack 20. Recovery is enhanced by placing exit port 108 at highest point 110 of vessel 12. Flare stack feed line 17 includes gas elbow 112, vessel vent stack 113, vessel vent flange 115, second back flow prevention valve 114, and T-joint input conduit 118. Thus, as depicted in FIGS. 5A-B, flare stack feed line 17 is secured to exit port 108 at flange 115, thereby providing fluid communication between vessel 12 and T-joint 64. Second backflow prevention valve 114, positioned between gas elbow 112 and T-joint second input 116, prevents waste gas from reentering vessel 12. In one embodiment, second backflow prevention valve 114 is a wafer valve. However, any one-way valve that is able to release waste gas to T-joint 64 is sufficient for the purposes of this invention. T-joint input conduit 118 provides fluid communication between T-joint 64 and T-joint second input 116.

Referring to FIGS. 5A-B, 12A-B and 13, a vessel drain line 120 extending from bottom segment 100 provides an alternate means of removing the mud-gas mixture from vessel 12. Vessel drain line 120 has drain line input port 121 where the mud-gas mixture exits vessel 12. Additionally, vessel drain line 120 preferably has valve 122 in-line and external to vessel 12. Preferably, valve 122 is a ball valve. Vessel drain line 120 is in fluid communication with catch tank 14 at tank front wall 124. In a preferred embodiment, vessel drain line 120 includes a drain line union 126 suitable for connecting vessel drain line 120 to catch tank 14. In an alternative embodiment, a flexible drain line (not shown) is attached at the point of drain line union 126.

Referring to FIGS. 7A-B, 9A-B, 10, and 12A-B, catch tank 14 has an open air grating 138 designed to allow the evaporation of any residual waste gas from the mud and mud-gas mixture. Overflow outlet 136 preferably passes through open air grating 138, terminating below it, thereby minimizing any backsplash from the mud and mud-gas mixture. Alternatively, overflow outlet 136 is positioned upon open air grating 138.

Valve 140 carried by tank dump line 142 is designed to permit the emptying of catch tank 14. Preferably, valve 140 is a ball type valve. Tank dump line 142 is depicted in FIGS. 7A-B and 12A-B as a horizontally placed line positioned on tank back wall 144. FIGS. 9A-B depict tank dump line 142 positioned inside of catch tank 14, with dump line intake 145 near catch tank bottom 143. However, as known to those skilled in the art, tank dump line 142 may be positioned at any location that allows the contents of catch tank 14 to be drained, and may be either a straight or curved line originating on the inside of catch tank 14.

In the embodiment of FIGS. 7A, 9A and 12A, pump 216 is designed to permit the concurrent drainage of catch tank 14. Concurrent drainage occurs as catch tank 14 is filling with the overflowing mud-gas mixture and is draining at the same time. T-joint 218 and valve 140 provide fluid communication between pump 216 and tank dump line 142. Output valve 220 is positioned between pump 216 and pump drain line 222 providing fluid communication therebetween. Pump drain line 222 provides fluid communication to another tank or similar device (not shown). Valve 140 permits removal of the overflowing mud-gas mixture from catch tank 14 without operation of pump 216.

Fluid level within catch tank 14 is controlled by the combination of upper and lower fluid sensors 226, 228, power/control panel 224 and pump 216. When fluid levels within catch tank 14 are below sensor 226, power/control panel 224 automatically precludes operation of pump 216. When the fluid level reaches sensor 226, a signal is transmitted to power/control panel 224. Power control panel 224 interprets the signal and automatically turns on pump 216. Pump 216 operates until fluid levels drop to below sensor 228, at which time sensor 228 transmits a signal to power/control panel 224.

Power/control panel 224 interprets the signal from sensor 228 and directs the shutdown of pump 216. Power/control panel 224 also provides for manual override of sensors 226 and 228. Power for the power/control panel 224 is externally provided. Alternatively, a portable generator (not shown) may be utilized to provide power.

Pump 216 is surrounded by drain barrier 230. Drain barrier 230 is an environmental containment area to ensure that any accidental leakage of mud will be contained. Drain barrier plug 232 allows the area to be drained if any mud does leak from pump 216.

FIGS. 7A-B, 9A-B, and 12A-B depict tank drain port 146 positioned at tank base 148 of tank back wall 144. Tank drain port 146 may be positioned on any of catch tank 14 walls as long as sufficient clearance is available to safely drain catch tank 14.

Vent line 16 is in fluid communication with wellbore 24. Gas tube 28 provides fluid communication from wellbore 24 to vent line 16 for transport of non-entrained waste gas to flare stack 20. Gas tube 28 is also referred to as a waste gas tube 28, while vent line 16 is also referred to as a waste gas vent line 16. Similarly, panic line 18 provides fluid communication between wellbore 24 and vessel 12 for transport of a mud-gas mixture. The mud-gas mixture hitting wear plate 208, or bottom segment 100, releases a portion of the entrained waste gas from the mud-gas mixture. Additionally, waste gas will also outgas from the mud-gas mixture while sitting in vessel 12. As waste gas separates from the mud, it accumulates in vessel 12. Waste gas accumulating in vessel 12 is communicated to flare stack 20 through vessel flare stack feed line 17, thereby permitting the safe disposal of waste gas. Vessel flare stack feed line 17 is also referred to as secondary gas vent line 17. Flare stack 20 is any flare stack capable of burning off waste gas from a well site. Vent line 16 and flare stack feed lines 17, 66, and 68 are sized to facilitate fluid communication of the waste gas to the flare stack burner 21.

As shown in FIG. 1, a production wellhead 34 is in fluid communication with wellbore 24. A mud-gas tube 30, joined to wellbore 24 at connection 32, provides fluid communication between wellbore 24 and mud-gas separator 26 during drilling and completion operations. Subsequently, a gas tube 28 provides fluid communication between mud-gas separator 26 and flare stack 20 through vent line 16. Mud-gas separator 26 collects the separated mud for recovery, recycling, or disposal. As known to those skilled in the art, other components and systems may be inserted between vent line 16 and wellbore 24 without interrupting the flow of waste gas. Alternatively, in production and/or completion operations, mud-gas separator 26 may not be required. Instead, production wellhead 34 is directly in fluid communication with vent line 16 through gas tube 28 or panic line 18.

Figure 3:
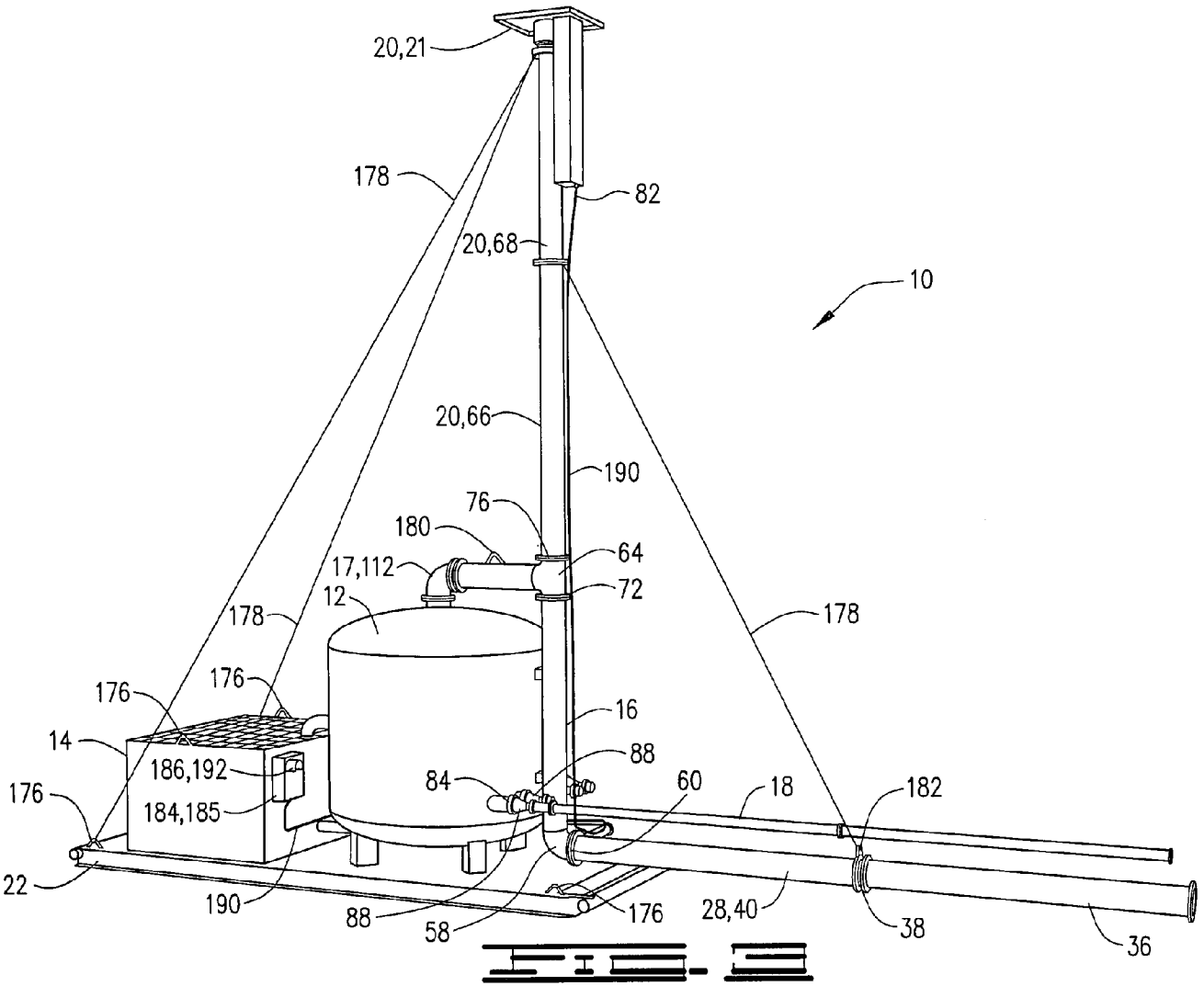
FIG. 3 depicts a front left side perspective view of an ecological friendly mud-gas containment system with a flare stack.
Figure 4:
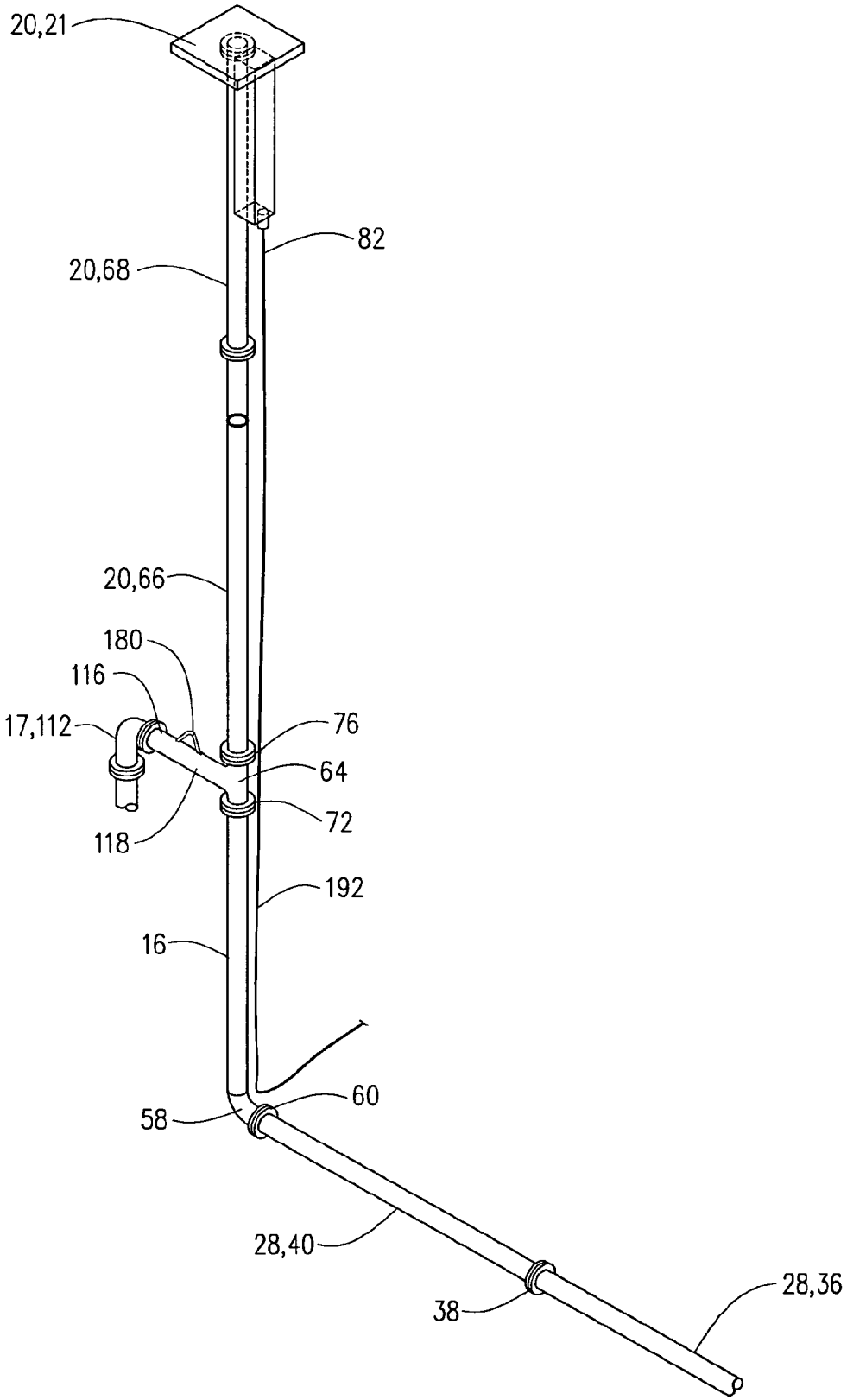
FIG. 4 depicts a right front perspective view of the gas vent line and the waste gas vent from the vessel, both in fluid communication with the flare stack.

As depicted in FIGS. 1, 3 and 4, the preferred embodiment of gas tube 28 includes a supply gas segment 36, a first backflow prevention valve 38, and terminal gas segment 40. Supply gas segment 36 provides fluid communication between mud-gas separator 26 and first backflow prevention valve 38. Terminal gas segment 40 provides fluid communication between first backflow prevention valve 38 and elbow 58.

In the preferred embodiment, elbow 58 and vent line 16 fluidly communicate waste gas from wellbore 24 to T-joint 64. As configured, T-joint 64 has T-joint first input 72 receiving waste gas from vent line 16, and T-joint second input 116 receiving waste gas from vessel 12. T-joint output 76 provides fluid communication from T-joint 64 to first flare stack feed line 66. In the preferred embodiment, T-Joint 64 permits the removal of flare stack 20 from the mud-gas containment system 10 for purposes of transporting mud-gas containment system 10 from a first well site to a second well site. As stated above, flare stack 20 includes first flare stack feed line 66, and second flare stack feed line 68. First flare stack feed line 66 is in fluid communication with second flare stack feed line 68. Second flare stack feed line 68 carries flare stack burner 21 and flare stack igniter 82. Although depicted as separate components, one skilled in the art will recognize that first flare stack feed line 66 and second flare stack feed line 68 may be replaced by a single, continuous feed line. Alternatively, additional flare stack feed lines may be added to first flare stack feed line 66 and second flare stack feed line 68 to further elevate flare stack 20 and flare stack burner 21.

Figure 10:
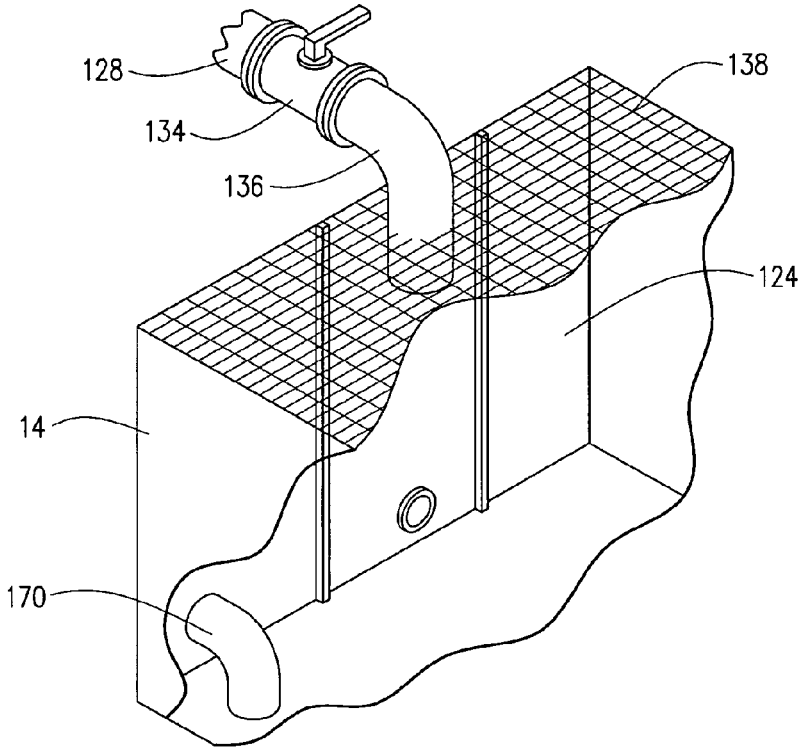
FIG. 10 depicts a perspective view of the catch tank interior front.
Figure 11:
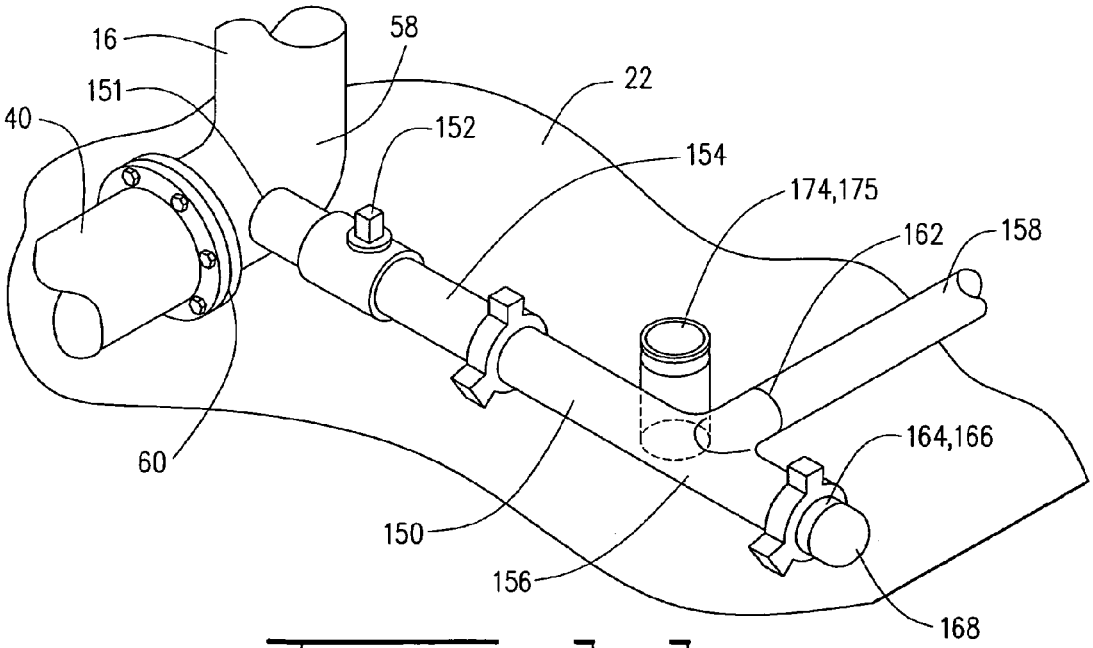
FIG. 11 depicts a perspective view of the vent line drain line and hose collar.

Referring to FIGS. 7A-B and 10, to prevent the build up of any residual mud within elbow 58, a trap 151 is positioned to communicate fluid from the lowest point of elbow 58. Trap 151, positioning at the lowest point of elbow 58 provides a flow conduit to keep vent line 16 free of mud. Trap 151 is preferably a ball valve that is carried by elbow 58. Trap 151 is in fluid communication with residual mud drain line 150, and is sized to be suitable for removing residue from elbow 58. Residual drain line 150 includes trap 151, output mud valve 152, input line 154, drain line T-joint 156, cleanout port 164, drain line 158, and catch tank input valve 160. Drain line 150 fluidly communicates residual mud through output mud valve 152 and to residual mud drain line T-joint 156. At drain line T-joint 156, the flow may be directed two different directions. A preferred first direction communicates the residual mud to catch tank 14. An alternate second direction allows the residual mud to be removed through clean out port 164.

The preferred first direction of flow provides for the residual mud to flow through drain line T-joint 156, drain line 158, and catch tank input valve 160, with the flow terminating in catch tank 14. Drain line 158 is connected to drain line T-joint first output 162 and carries the residual mud to catch tank input valve 160. Catch tank input valve 160 is in fluid communication with catch tank residual input port 170 shown in FIG. 10. Catch tank residual input port 170 directly dumps any residual mud into catch tank 14. Catch tank residual input port 170 provides fluid communication through catch tank front wall 124 to the interior of catch tank 14. In the preferred embodiment, output mud valve 152 and catch tank input valve 160 are ball valves. However, any type of valve that is either manually, remotely, or automatically operated and allows the residual mud to flow will suffice.

The alternate second direction passes residual mud through drain line T-joint second output 166 and clean out port 164. Cleanout port 164 allows direct access to input line 154 and elbow 58. Cleanout port 164 preferably has removable cleanout cap 168 covering it.

Mud-gas containment system 10 has several access points and ports to permit cleaning or servicing in between jobs. For example, vessel 12 includes a manhole 172, while access to elbow 58 is accomplished by removing cleanout cap 168 which is covering clean out port 164 at drain line T-joint second output 166. Finally, FIGS. 2, 6, 7A-B, and 12A-B depict collar 174, affixed to mobile skid 22, as providing a storage/transit point for standard connector 175. Standard connector 175 permits attachment of a standard clean out hose to clean out port 164. Additionally, clean out port 164 is sized to accept a clean out tool therethrough. Furthermore, clean out port 164 preferably accepts an adapter for the standard clean out hose.

As described herein, mud-gas containment system 10 is a portable system suitable for movement from a first well site to a second well site, or some other location, without requiring complete disassembly. In the preferred embodiment, vessel 12, catch tank 14, vent line 16, flare stack 20 and associated supply line connections are all mounted on mobile skid 22. Flare stack 20 is preferably detached or removed prior to transporting the system. Additionally, panic lines 18 and gas tube 28 are detachable from mud-gas containment system 10 to facilitate its mobility. Mobile skid 22 is preferably sized to be transportable on United States' state or federal highways.

Figure 2:
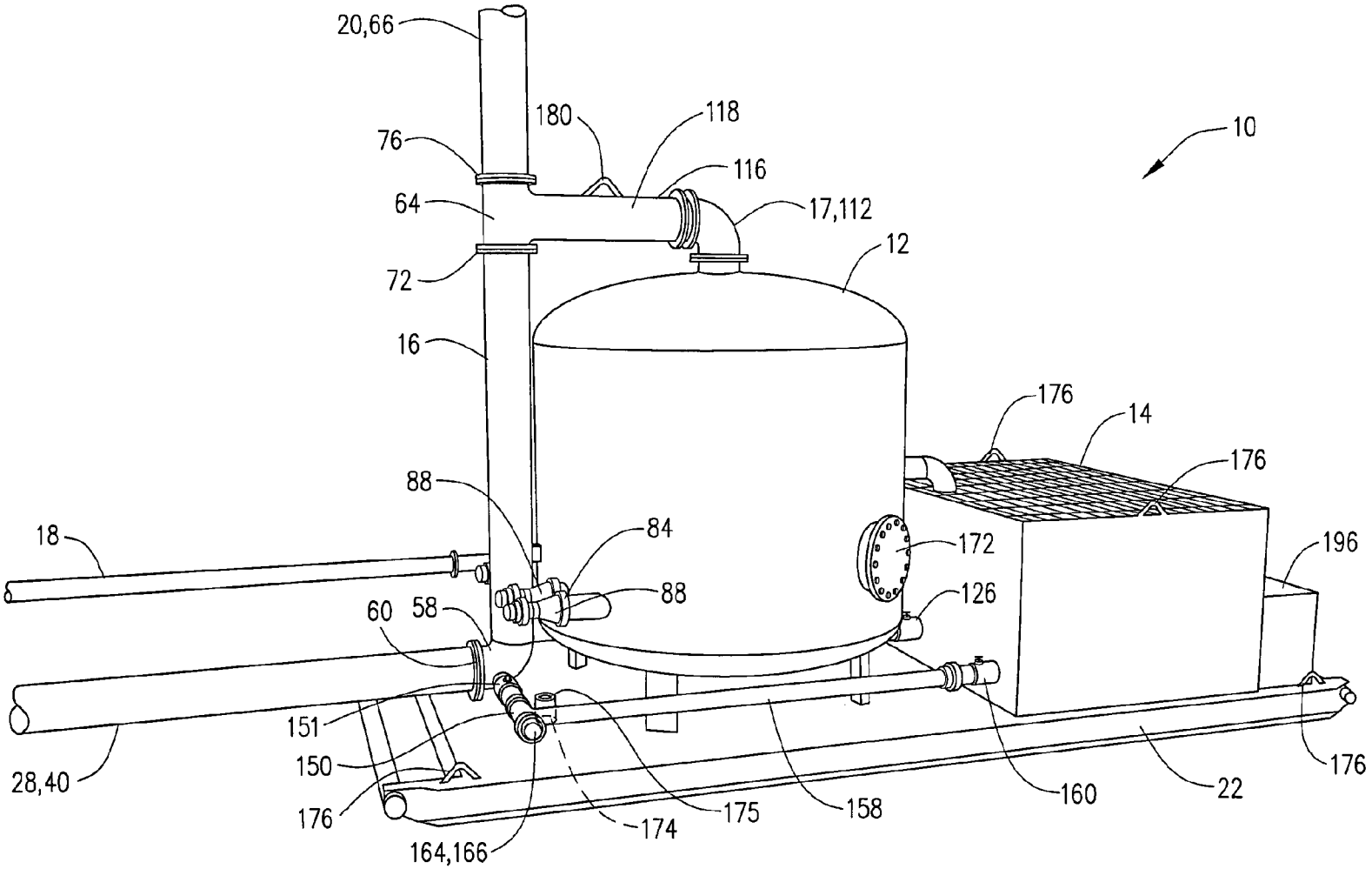
FIG. 2 depicts a front right side perspective view of an ecological friendly mud-gas containment system.

As shown in FIGS. 2 and 3, the mobility of skid 22 is enhanced by inclusion of lift points 176. Lift points 176 are designed to function as stabilizing points for attaching guy line 178 to flare stack 20. An additional lift point 180 is shown on top of conduit 118. An additional stabilizing point 182 is shown affixed to the top of gas tube 28. When mud-gas containment system 10 is assembled, a plurality of guy lines 178 stabilize flare stack 20. Guy lines 178 are removably connected to lift points 176 near or on catch tank 14, and to stabilizing point 182.

Referring to FIGS. 2, 7A-B, and 12A-B, tool box 196 is affixed to catch tank 14 on tank back wall 144. Preferably, tool box 196 is sealable from the weather and is capable of being locked. Tool box 196 is preferably sized to store guy lines 178 and other tools necessary to set up and tear down mud-gas containment system 10.

As shown in FIG. 3, the preferred embodiment of mud-gas containment system 10 includes a first control panel 185 mounted upon catch tank 14. As part of control system 184, control panel 185 preferably controls and regulates the remotely operated ignition/cutoff switch 186, ignition line 190, flashing light 192 and flare stack igniter 82. Control panel 185 also preferably receives the input of the signal generating from a remote device that provides a signal causing control panel 185 to send an electronic signal to flare stack igniter 82 over ignition line 190. Flashing light 192 signals operation of flare stack 20. Control panel 185 also provides for manual override and control of all of the signals.

Method

The current invention also provides a method of ecologically containing a mud-gas mixture and safely disposing waste gas. In the preferred embodiment, this method utilizes the mud-gas containment system 10 described above. Mud-gas containment system 10 is transported to a wellsite across a United States' federal or state highway without requiring a special permit.

Once at the wellsite, gas tube 28 detachably connects to vent line 16. If mud-gas separator 26 is employed, it is normally positioned between wellbore 24 and vent line 16. Thus, gas tube 28 is optionally interrupted by mud-gas separator 26. If mud-gas separator 26 is not employed, gas tube 28 is detachably connected to well head 34. At least one detachable panic line 18 is fluidly connected to vessel 12 at conical adapter 88 and to well head 34.

Flare stack 20 is assembled at either T-joint first input 72, or T-joint output 76, whichever was the selected detachment point for transporting mud-gas containment system 10. If utilized, a separate off-skid holding tank for catch tank 14 is connected to pump drain line 222 and a separate field power unit is attached to power/control panel 224. The separate field power unit provides power to operate pump 216. Additionally, remote ignition/cutoff switch 186 preferably is positioned at a distant control point. The distant control point being established by the field personnel subsequent to the assembly of the mud-gas containment system 10. Guy lines 178 are attached to lift points 176 and flare stack 20 to support the structure.

During drilling and completion operations, mud-gas mixture from wellbore 24 flows to mud-gas separator 26 for separation of waste gas. Released waste gas passes from separator 26 to vent line 16 and flare stack 20. Upon initial startup of mud-gas containment system 10, remote ignition/cutoff switch 186 is activated to ignite the waste gas, thereby starting the flame in burner 21.

The mud-gas mixture being fluidly communicated in panic line 18 is a result of an intentional release of mud-gas from wellbore 24, or from an emergency situation. Within vessel 12, the mud-gas mixture flows from outlet port 204, impacts on wear plate 208 of vessel 12, thereby causing the mixture to splash. Alternatively, when the mud-gas mixture flows from dump opening 98, the mud-gas mixture impacts on bottom segment 100 of vessel 12, which also causes splashing. Discharging, releasing or splashing mud-gas mixture on wear plate 208, baffle 102 and top splash plate 106 enhances the release of waste gas from the mud-gas mixture. The released entrained gas is a waste gas that is communicated to flare stack 20 to be burned in burner 21.

When the volume of mud-gas mixture reaches a pre-determined level, a portion thereof is transferred to catch tank 14. The mud-gas mixture begins to flow to catch tank 14 when the volume of mud-gas mixture in vessel 12 rises up overflow line 128 and reaches a level that it is co-planar with horizontal segment 132. Preferably, valve 134 is open, and the mud-gas mixture flows out through overflow outlet 136 into catch tank 14. This action prevents vessel 12 from impeding the flow of the mud-gas mixture from wellbore 24.

As the mud-gas mixture enters catch tank 14, it first encounters lower level sensor 228. As the mud-gas mixture begins to fill-up catch tank 14, it encounters and triggers upper level sensor 226. Upper level sensor 226 sends a signal to power/control panel 224. When control power/control panel 224 receives a signal from upper level sensor 226, power/control panel 224 automatically starts pump 216, thereby transferring the mud-gas mixture in catch tank 14 to a separate, off-skid holding tank. Upper level sensor 226 precludes accidental overflows and/or spillages of the mud-gas mixture from catch tank 14. When the volume within catch tank 14 drops below a pre-determined level, lower level sensor 228 sends a signal to power/control panel 224, stopping pump 216, and thereby terminating the flow to the separate, off-skid holding tank. Preferably, any time delays between sensors 226, 228, power/control panel 224 and pump 216 are negated by the placement of sensors 226, 228 to ensure pump 216 is turned on and off at the proper time.

Occasionally, vent line 16 has a buildup of residual mud at elbow 58. Preferably, prior to removing the residual mud build up in elbow 58, all operations of mud-gas containment system 10 are stopped to ensure the safety of personnel performing maintenance. The residual mud is removed by opening valves 152 and 160 to allow the mud to flow through residual mud drain line 150 to catch tank 14. Alternatively, only valve 152 is opened, and the residual mud is removed through clean out port 164. Once clean out port 164 is removed to clear the buildup of mud, a clean out tool is inserted into clean out port 164. Alternatively, a standard clean out hose is used to spray liquid, such as water, into clean out port 164. Both methods are effective at removing the buildup of mud. The mud is extracted to either catch tank 14, or directly through clean out port 164 into a portable container.

When operations at a wellsite are complete, the mud-gas containment system is disassembled in reverse of the assembly instructions mentioned above. The disassembled mud-gas containment system is then transported to another wellsite or back to the shop.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

We claim:

1. A mobile mud-gas containment system for use at a wellbore at a wellsite, the mobile mud-gas containment system comprising:

a skid;

a flare stack carried by the skid;

a vessel in which a mud-gas mixture is adapted to be contained, wherein the vessel is mounted upon the skid, wherein the vessel is adapted to receive fluid communication from the wellbore and is fluidly communicating with the flare stack, and wherein the vessel comprises:

a bottom segment, a top wall vertically spaced from the bottom segment, and an exit port formed through the top wall and via which waste gas is adapted to flow out of the vessel;

wherein the flare stack is in fluid communication with the exit port of the vessel and is adapted to burn off the waste gas at the wellsite;

a vessel flare stack feed line connected to the exit port;

a joint connected to the vessel flare stack feed line, wherein the flare stack is connected to the joint and extends in an upward direction;

a vent line mounted upon the skid and connected to the joint, the vent line fluidly communicating with each of the flare stack and the vessel, wherein the vent line extends in a downward direction from the joint, and wherein the vent line carries a trap adapted and sized to capture a volume of a residual mud;

a catch tank mounted upon the skid, the catch tank in fluid communication with the vessel, wherein the vessel, the flare stack, the vent line, and the catch tank are transportable from a first well site to a second well site upon the skid; and a drain line, the drain line providing fluid communication between the trap and the catch tank; and an overflow line providing, at least in part, the fluid communication between the vessel and the catch tank, the overflow line comprising:

a first segment extending within the vessel, a second segment disposed within the vessel and extending downward from the first segment, and an intake located at the end of the second segment opposite the first segment, wherein the intake of the overflow line is positioned within the vessel and near the bottom segment of the vessel;

wherein the overflow line is configured so that, when a volume of the mud-gas mixture reaches a pre-determined level within the vessel, at least a portion of the mud-gas mixture is adapted to flow from the vessel to the catch tank via the overflow line.

2. A mud-gas containment system for use at a wellsite, the mud-gas containment system comprising:

a vessel in which a mud-gas mixture is adapted to be contained, the vessel comprising:

a bottom segment, a top wall vertically spaced from the bottom segment, and an exit port formed through the top wall and via which waste gas is adapted to flow out of the vessel;

a vessel flare stack feed line connected to the exit port;

a joint connected to the vessel flare stack feed line;

a flare stack connected to the joint, in fluid communication with the exit port of the vessel and adapted to burn off the waste gas at the wellsite;

a vent line connected to the joint and in fluid communication with each of the flare stack and the vessel, wherein the vent line extends in a downward direction from the joint and the flare stack extends in an upward direction;

a trap carried by the vent line and adapted to capture a volume of residual mud;

a catch tank in fluid communication with the vessel; and an overflow line providing, at least in part, the fluid communication between the vessel and the catch tank, the overflow line comprising:

a first segment extending within the vessel, a second segment disposed within the vessel and extending downward from the first segment, and an intake located at the end of the second segment opposite the first segment, wherein the intake of the overflow line is positioned within the vessel and near the bottom segment of the vessel;

wherein the overflow line is configured so that, when a volume of the mud-gas mixture reaches a pre-determined level within the vessel, at least a portion of the mud-gas mixture is adapted to flow from the vessel to the catch tank via the overflow line.

3. The mud-containment system of claim 2, wherein the overflow line further comprises an overflow outlet positioned outside of the vessel;

wherein the overflow outlet is in fluid communication with the first segment;

and wherein at least a portion of the overflow outlet extends downward towards the catch tank.

4. The mud-containment system of claim 3, wherein the overflow line further comprises a valve fluidically positioned between the first segment and the overflow outlet.

5. The mud-containment system of claim 2, wherein the overflow line comprises a valve;

wherein the valve is configured to permit fluid flow from the vessel to the catch tank; and wherein the valve is configured to prevent fluid flow into the vessel via the overflow line.

6. The mud-gas containment system of claim 2, further comprising a backflow prevention valve fluidically positioned between the exit port and the flare stack;

wherein the backflow prevention valve is configured to permit fluid flow from the exit port to the flare stack; and wherein the backflow prevention valve is configured to prevent fluid flow from the flare stack to the exit port.

7. The mud-containment system of claim 2, further comprising a first drain line extending between the bottom segment of the vessel and the catch tank, the first drain line providing in part the fluid communication between the vessel and the catch tank;

wherein the first drain line is configured so that another portion of the mud-gas mixture is adapted to flow from the vessel to the catch tank via the first drain line and independently of the overflow line.

8. The mud-gas containment system of claim 7, further comprising a second drain line fluidically positioned between the trap and the catch tank;

wherein the second drain line is configured so that at least a portion of the residual mud is adapted to flow from the trap to the catch tank via the second drain line and independently of each of the overflow line and the first drain line.

9. The mud-gas containment system of claim 2, further comprising a drain line fluidically positioned between the trap and the catch tank;

wherein the drain line is configured so that at least a portion of the residual mud is adapted to flow from the trap to the catch tank via the drain line and independently of the overflow line.

* * * * *